United States Patent [19]

Rutter et al.

[11] Patent Number: 4,484,929

[45] Date of Patent: Nov. 27, 1984

[54] SOLID FUEL OIL MIXTURES

[75] Inventors: Paul R. Rutter, Richmond; Christopher J. Veal, Wimbledon Chase, both of England

[73] Assignee: The British Petroleum Company p.l.c., London, England

[21] Appl. No.: 432,963

[22] Filed: Oct. 5, 1982

[30] Foreign Application Priority Data

Oct. 30, 1981 [GB] United Kingdom ..... 8132729

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 3,902,869 | 9/1975 | Friberg et al. | 44/51 |
| 4,069,022 | 1/1978 | Metzger | 44/51 |
| 4,162,143 | 7/1979 | Yount | 44/51 |
| 4,177,039 | 12/1979 | Sakuma et al. | 44/51 |
| 4,363,637 | 12/1982 | Knitter et al. | 44/51 |
| 4,364,741 | 12/1982 | Villa | 44/51 |
| 4,364,742 | 12/1982 | Knitter et al. | 44/51 |

FOREIGN PATENT DOCUMENTS 55-56189 4/1980 Japan .

*Primary Examiner*—Y. Harris-Smith

*Attorney, Agent, or Firm*—Morgan, Finnegan, Pine, Foley & Lee

[57] ABSTRACT

Fuel composition comprises (a) 15 to 60% be weight, preferably 40 to 55%, of a friable solid fuel, e.g. coal, (b) a stabilizing additive composition and (c) a fuel oil. The additive comprises the combination of a polymer containing functional groups, e.g., maleinized polybutadiene, and a surfactant. The composition is suitable for use as a liquid fuel for industrial burners.

3 Claims, No Drawings

SOLID FUEL OIL MIXTURES

This invention relates to mixtures of solid fuel, particularly coal, in oil.

Coal-oil slurries have previously been disclosed, see for example, British Patent Specification No. 975687. Whilst these have behaved as near-Newtonian non-settling fluids in pipelines, they separate on standing. Thus such slurries are suitable for use immediately after preparation or pipelining, but are not suitable for transportation by tanker nor for storage.

More recently, numerous patent specifications have been published which describe the stabilisation of coal oil mixtures by the addition of various surfactant compounds.

We have now discovered that solid fuel particles admixed in oil can be stabilised by the addition of a polymer containing functional groups and a surfactant.

Thus according to the present invention there is provided a fuel composition containing (a) 15 to 60% by weight, preferably 40 to 55% by weight, of particles of a friable solid fuel, (b) an additive composition comprising the combination of a polymer containing functional groups, and a surfactant and (c) a fuel oil, the percentage being expressed as a percentage by weight of the total weight of the composition.

The additive composition is preferably present in the fuel composition in amount 0.01 to 1.0, most preferably 0.05 to 0.5% by weight of the total weight of the fuel composition. The components may be added separately or together.

The polymer may be a liquid polymer, a solution or dispersion of a liquid or solid polymer in a suitable solvent or diluent, or a soluble solid polymer.

The polymer may be any polymer capable of being functionalised. It is preferably a polyolefin and more particularly a polymer of a mono- or di-olefin containing, before functionalisation, at least one and preferably a plurality of pendant vinyl groups.

The polyolefins may be derived in known manner from conjugated dienes such as butadiene, isoprene and chloroprene and mono-olefins such as isobutene and 4-methylpentene-1.

Suitable polymers may also be obtained from linear mono-olefins such as ethylene and/or propylene; acrylates and methacrylates having sufficiently long chains to give oil solubility; and substituted styrenes such as t-butyl styrene.

Polymers derived from naturally occurring substances may also be used, provided they can be functionalised, e.g. linseed or soya bean oil and natural rubber.

The molecular weight of the polymer may vary widely depending on its type and may range from 250 (e.g. linseed oil) to $1\times10^6$ or more (e.g. natural rubber) with intermediate values for synthetic polymers (e.g. 1,000–20,000 for maleinised polybutadiene and 200,000 to 500,000 for maleinised polyisoprene).

The polymers may be functionalised by the incorporation of carboxylic acid, anhydride or acid chloride groups by known techniques. Convenient methods are maleinisation across double bonds in the polymer or copolymerisation with a reactant containing the required functional groups. Similarly, alcohol or amine groups may be incorporated by known techniques.

The extent of functionalisation will depend on the number of sites (e.g. double bonds) which can readily be functionalised or, in the case of copolymerisation, the proportion of reactants. The extent of functionalisation may thus vary widely depending on the type of polymer and may range from 1% (e.g. natural rubber) to 50% (e.g. linseed oil). Preferably the extent of functionalisation is from 1 to 15% by weight.

There may be residual unsaturation remaining after functionalisation. Preferably, however, the functionalised polymer is substantially saturated to increase storage life and improve miscibility with the organic material. The functionalised polymer may be hydrogenated, if necessary, to achieve this.

The term "polymer" includes copolymers and from the above-discussion it will be seen that a number of factors have to be balanced to give the optimum functionalised polymer. Desirably, the functionalised polymer has a long chain with minimum branching between functional groups. The polymer, before functionalisation, desirably therefore has well spaced-out residual unsaturated groups which can be functionalised. The overall molecular weight may thus be relatively high, but this has to be balanced against the fact that relatively large amounts of solvent may be needed to give a liquid polymer as herein defined.

Preferred polymers may thus be maleinised polybutadiene, polyisoprene, EPDM rubber or natural rubber. Maleinised polybutadienes having a molecular weight of from 5,000–20,000 are commercially available, e.g. those sold under the trade name "Lithene" by Revertex Limited.

Suitable surfactants include anionic, cationic and non-ionic surfactants, e.g. alkali metal carboxylates, alkyl sulphates, alkyl sulphosuccinates, and alkyl aryl sulphonates; quarternary ammonium compounds; alkylene oxide condensates and alkanolamides.

In certain circumstances, the combination of a polymer containing functional groups and an anionic surfactant together with a cationic surfactant is particularly effective.

The polymer is preferably present in amount 10 to 90% by weight, expressed as a percentage of the total weight of polymer and surfactant.

Suitable friable solid fuels include coals of various ranks, solvent refined coal, coal coke and petroleum coke. The preferred solid fuel is bituminous coal.

Preferably the solid fuel particles are pre-ground to a particle size not greater than 250 micron.

The preferred oil is a petroleum based fuel oil fraction having a viscosity of not more than 600 cSt at 50° C., preferably not more than 380 cSt at 50° C. The required viscosity may be achieved by "cutting back" if necessary with, for example, gas oil.

In the case of certain heavier fuel oil fractions it may be necessary to heat them in order to render them sufficiently mobile to permit dispersal of the solid fuel particles therein.

The solid fuel, additive composition and oil are preferably blended together in a low speed mixer.

The resulting solid fuel-oil mixtures are suitable for use in blast furnaces and cement kilns, and in industrial, marine and utility boilers.

The invention is illustrated with reference to the following:

EXAMPLES 1–3

Littleton bituminous coal of NCB Coal Rank 802 was used as the solid fuel. Initially it was in the form of pulverised fuel.

| Ultimate Analysis | |
|---|---|
| Carbon Content | 74.7% wt. |
| Hydrogen | 4.04 |
| Nitrogen | 1.7 |
| Sulphur | 0.89 |
| Water | 6.5 |
| Ash at 815° C. | 3.7 |
| Size Analysis | |
| +250 μm | — |
| 106–250 | 20.5 |
| 75–106 | 5.6 |
| 53–75 | 11.2 |
| −53 | 62.7 |

The oil was a mixed source heavy fuel oil having a nominal viscosity of 380 cSt at 50° C.

It had the following properties:

| | |
|---|---|
| Sulphur Content % wt. | 1.89 |
| Water % wt. | 0.05 |
| Specific Gravity @ 15.6° C./15.6° C. | 0.9751 |
| Kinematic viscosity 60° C. cSt | 447 |
| 80° C. | 129 |
| 100° C. | 61 |

EXAMPLE 1

50 g Littleton pulverised coal was slowly added with continuous stirring to 50 g fuel oil heated to 70° C. in a low speed mixter to give a mixture containing 50% by wt coal and 50% by weight oil.

0.2 g Aerosol TR 70, sodium bistridecyl sulphosuccinate sold under that name by Cyanamid Ltd. was then added and the mixture stirred for 15 minutes. This was followed by the addition of 0.3 g LX16 20MA a polybutadiene substituted by maleic anhydride groups sold by Revertex Ltd. The mixture was then stirred thoroughly for 10 more minutes to stabilise it.

The stability was measured by the technique set out on page 3 of the paper "Stable Coal/Fuel Oil Dispersions" presented at the 2nd International Symposium of Coal Oil Mixture Combustion, Danvers, Mass., USA, Nov. 27–29, 1979 by Veal et al.

In short, this involves determining the concentration of solids present at the base of a standard tube kept at a temperature of 100° C. for 24 hours and subtracting from it the initial concentration of solid in the mixture. Clearly, the greater the difference, the more the solids have separated and the more unstable is the mixture.

The mixture showed an increase in base coal content of 2.4% wt.

EXAMPLE 2

Example 1 was repeated using the surfactant Aerosol MA80, sodium dihexyl-sulphosuccinate, in place of Aerosol TR70.

The resulting coal oil mixture showed an increase in base coal content of 7.0% wt.

EXAMPLE 3

The procedure of Example 1 was again carried out, this time replacing the anionic surfactant by a cationic one sold under the name Ethoquad 18/12 by Akzo Chemie, namely methyl bis (2-hydroxyethyl) octadecyl ammonium chloride.

The resulting coal oil mixture showed an increase in base coal content of 7.0% wt.

By way of comparison, similar experiments were performed in which either or both the polymer and surfactant were omitted with the following results

| | Increase in Base Coal Content, % wt. |
|---|---|
| Control sample, i.e. no polymer and no surfactant | 17% |
| Polymer LX1620MA but no surfactant | 17% |
| Surfactant Aerosol TR70 but no polymer | 15% |

These results clearly show the considerable increase in stability produced by the combination of the polymer and the surfactant. The surfactant alone gives only slight improvement and the polymer alone gives none.

EXAMPLE 4

Herrington coal of NCB Rank was used as the solid fuel. Initially it was in the form of pulverised fuel.

| Ultimate Analysis | |
|---|---|
| Carbon content | 79.4% wt |
| Hydrogen | 4.84 |
| Nitrogen | 2.4 |
| Sulphur | 1.2 |
| Water | 1.6 |
| Ash at 815° C. | 5.7 |

| Size Analysis | |
|---|---|
| +212 μm | 0.4% wt |
| 212–125 | 5.4 |
| 125–75 | 16.7 |
| 75–53 | 13.4 |
| −53 | 64.1 |

The oil was used as in Examples 1–3.

The procedure of Example 1 was repeated to give a mixture containing 45.7% by weight of coal stabilised by 0.1% Polymer, LX16 20MA, 0.05% Aerosol TR70 and 0.05% Ethoquad 0/12. The latter is a cationic surfactant, methylbis (2-hydroxyethyl)alkyl chloride sold by Akzo Chemie.

The resulting mixture showed an increased in base coal content of only 2.2% after 24 hours at 100° C. and 4.0% after 7 days at 80° C.

We claim:

1. A stable fuel composition consisting essentially of (a) 45.7% by weight of particles of a coal, (b) an additive composition in an amount 0.2% by weight, said additive being the combination of maleinised polybutadiene in an amount of 0.1% by weight and a surfactant which is a mixture of 0.05% by weight of methylbis(2-hydroxylethyl) alkyl chloride ammonium compound and sodium bis tri decyl sulfosuccinate and (c) fuel oil being the remaining component.

2. A fuel composition according to claim 1 wherein the solid fuel particles are preground to a particle size not greater than 250 micron.

3. A fuel composition according to claim 1 wherein the fuel oil is a petroleum based fuel oil fraction having a viscosity of not more than 600 cSt at 50° C.

* * * * *